United States Patent [19]

Weiss

[11] 3,935,368

[45] Jan. 27, 1976

[54] VINYL CHLORIDE FLOORING MATERIAL COATED WITH A HYDROPHILIC ACRYLIC POLYMER

[75] Inventor: Jonas Weiss, Plainfield, N.J.

[73] Assignee: National Patent Development Corporation, New York, N.Y.

[22] Filed: July 1, 1971

[21] Appl. No.: 158,824

[52] U.S. Cl. ..... 428/337; 427/385; 428/339; 428/520

[51] Int. Cl.[2] ..... B05D 3/02; B32B 27/08

[58] Field of Search ..... 117/16 UT, 16 UB, 16 UC, 117/138.8 UA; 161/254; 428/337, 339, 520; 427/385

[56] References Cited

UNITED STATES PATENTS

| | | | |
|---|---|---|---|
| 2,681,897 | 6/1954 | Frazier et al. | 260/86.1 |
| 2,816,852 | 12/1957 | Banks | 161/254 |
| 2,987,103 | 6/1961 | Yakubik | 161/254 |
| 3,216,852 | 11/1965 | Goldberg | 117/161 UB |
| 3,249,463 | 5/1966 | Carlee | 117/161 UT |
| 3,296,723 | 1/1967 | Gobel | 117/161 UT |
| 3,311,583 | 3/1967 | Bearden | 117/161 UT |
| 3,361,696 | 1/1968 | Bolgiano et al. | 117/161 UT |
| 3,519,527 | 7/1970 | Crowley | 117/161 UB |
| 3,560,237 | 2/1971 | Miller | 117/161 UT |
| 3,567,118 | 3/1971 | Shepherd et al. | 117/161 UB |
| 3,577,311 | 5/1971 | Reiter et al. | 161/254 |

*Primary Examiner*—William D. Martin
*Assistant Examiner*—Sadie L. Childs
*Attorney, Agent, or Firm*—Cushman, Darby & Cushman

[57] ABSTRACT

A hydrophilic hydroxyalkyl or lower alkoxyalkyl acrylate or methacrylate polymer is employed as a protective coating for a vinyl chloride resin or polymer flooring material. A glossy surface is produced which can be maintained by buffing without waxing. Improved soil and stain resistance are also imparted to the flooring.

2 Claims, 2 Drawing Figures

Fig. 1
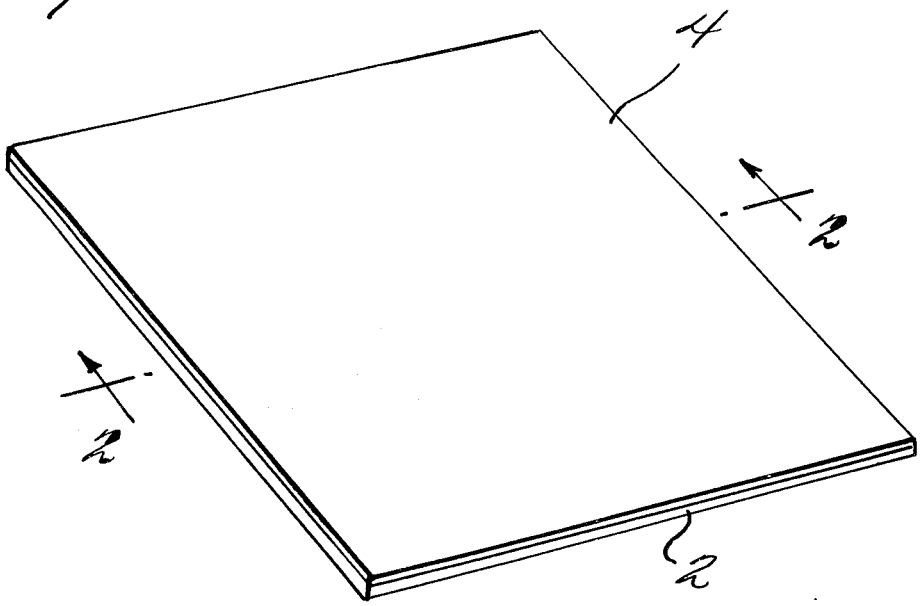
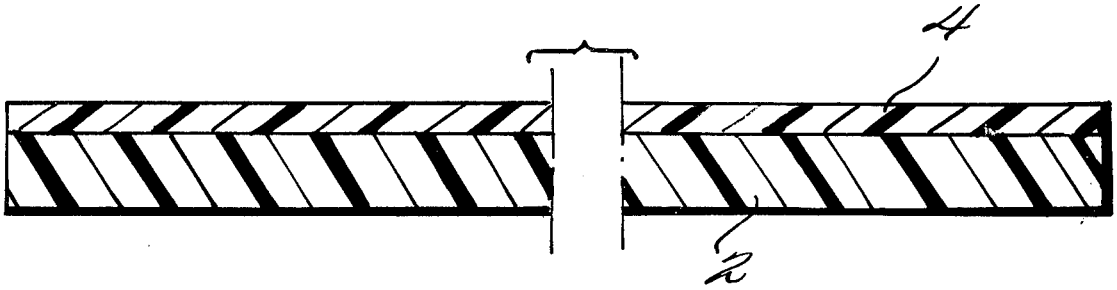
Fig. 2
INVENTOR
JONAS WEISS
BY Cushman, Darby & Cushman
ATTORNEYS

VINYL CHLORIDE FLOORING MATERIAL COATED WITH A HYDROPHILIC ACRYLIC POLYMER

The present invention relates to flooring materials such as vinyl floor tiles and vinyl sheeting.

Existing flooring materials, such as vinyl floor tiles and vinyl sheeting, e.g., from vinyl chloride resins or polymers require protective coatings to reduce soiling, staining, and prevent reduction of gloss through abrasion. Conventional protective coatings, such as waxes and factory-applied finishes, are only partially effective, and in addition have very short lifetime in comparison to that of the flooring material, necessitating frequent maintenance. The protective coatings described in this invention have improved soil-and stain-resistance and cleanability, which allows significantly less maintenance. Also, many of the materials described are permanent coatings, which require only the usual cleaning, but no stripping and reapplication, as in the case of conventional waxes. A permanent, glossy surface can be maintained by buffing without waxing.

The protective coatings of this invention are hydrophilic acrylic polymers (including copolymers which also embraces terpolymers, tetrapolymers, etc.) These include polymers of hydroxyl-containing lower alkyl acrylates or methacrylates, such as hydroxyethyl methacrylate or hydroxy propyl acrylate, or lower alkoxy-containing lower alkyl acrylates or methacrylates, such as ethoxyethyl acrylate or methoxyethyl methacrylate, or carboxyl - containing monomers such as methacrylic acid or acrylic acid.

Additional hydrophilic polymers include polymers of hydroxypropyl methacrylate, hydroxy ethyl acrylate, ethoxyethyl methacrylate, and methoxyethyl acrylate methoxypropyl acrylate.

The lower alkoxy groups of the hydrophilic alkoxyalkyl acrylates and methacrylates generally having 1 to 2 carbon atoms and the preferred lower alkyl groups of the hydroxyalkyl and alkoxyalkyl acrylates and methacrylates have 2 to 3 carbon atoms.

For most purposes, the hydroxyalkyl acrylate and methacrylate polymers are preferred, particularly the polymers of 2-hydroxyethyl methacrylate (HEMA).

Hardness and elasticity can be adjusted by copolymerizing with hydrophobic monomers that give hard, relatively non-elastic films such as alkyl methacrylates such as methyl methacrylate, ethyl methacrylate, propyl methacrylate, butyl methacrylate, dodecyl methacrylate, as well as other hydrocarbyl methacrylates having up to 12 carbon atoms or more in the hydrocarbyl groups, e.g., norbornyl methacrylate.

On the other hand, softer and more elastic copolymer films can be obtained by copolymerizing with methyl acrylate, ethyl acrylate, n-butyl acrylate, octyl acrylate, dodecyl acrylate, 2-ethyl hexyl acrylate or other hydrocarbyl acrylates having up to 12 carbon atoms or more in the hydrocarbyl group, e. g., norbornyl acrylate.

Sensitivity to water and water-borne stains, and strippability with a basic cleaning solution, such as aqueous ammonia, can be adjusted by varying the amount of hydrophilic component in the polymer; carboxyl groups especially impart sensitivity to basic cleaning solutions. The polymer may be crosslinked to form a permanent coating on the flooring, or may be left uncrosslinked to give a removable coating. Metal salts, such as ammonium dichromate or diepoxide and anhydrides and aminoplasts, may be used to crosslink the hydroxyl-containing polymers. Also conventional polyethylenically unsaturated crosslinking agents can be used.

Thus, there can be used 0.25 to 20%, usually 0.5 to 10%, preferably not over 2%, of a polyethylenically unsaturated compound such as ethylene glycol diacrylate, ethyleneglycol dimethacrylate, diethylene glycol dimethacrylate, divinyl benzene, divinyl toluene, triallyl melamine, N, N'-methylene-bis-acrylamide, glycerine trimethacrylate, diallyl maleate, divinyl ether, diallyl mono ethylene glycol citrate, allyl vinyl maleate, ethylene glycol vinyl allyl citrate, diallyl itaconate, ethylene glycol diester of itaconic acid, propylene glycol dimethacrylate, propylene glycol diacrylate, divinyl sulfone, hexahydro-1,3,5-triacryltriazine, triallyl phosphite, diallyl ester of benzene phosphonic acid, polyester of maleic anhydride with triethylene glycol, diethylene glycol diacrylate, polyallyl sucrose, polyallyl glucose, e. g., diallyl sucrose and triallyl glucose, sucrose diacrylate, glucose dimethacrylate, pentaerythritol diacrylate, sorbitol dimethacrylate.

As the aminoplasts there are used condensation products of an aldehyde, preferably formaldehyde, with a urea (i. e., urea per se or substituted ureas) or aminotriazine, e. g., urea, thiourea, ethylene urea, dicyandiamide, melamine, benzoguanamine, acetoguanamine, formoguanamine, ammeline, ammelide, 2,4,6-triethyl triamino 1,3,5-triazine, 2,4,6-triphenyl triamino 1,3,5-triazine as well as the other amino triazines disclosed in Widmer U.S. Pat. No. 2,197,357 for example. The aminoplast is normally present as a solvent dispersion of a solvent dispersible, fusible, thermosetting, aminoplast resin forming reaction product of the urea or aminotriazine and the aldehyde. The aminoplast is normally soluble in water and/or alcohol. It can be a low molecular weight resin or a monomer such as dimethylolurea, sesquimethylol urea, trimethylol melamine, dimethylol melamine, hexamethylol melamine, trimethylol melamine trimethyl ether, hexamethylol melamine hexamethyl ether or trimethylol benzoguanamine for example. The use of melamine or other aminotriazines is preferred to urea.

The aminoplasts are used in minor amount, e. g. 0.1 to 10% of the weight of the hydrophilic polymer, and the ammonium dichromate is normally used in an amount of 0.02–1% by weight of the hydrophilic polymer.

As epoxides this can be used with a polyepoxide containing at least two vicinal epoxy groups. Illustrative examples of such a polyepoxide include cycloaliphatic diepoxide such as vinyl cyclohexene dioxide, 3,4-epoxycyclohexylmethyl-3',4'-epoxycyclohexane carboxylate (Unox 221); 3,4-epoxy - 6 - methyl cyclohexylmethyl -3',4'- epoxy - 6 - methylcyclohexamine carboxylate (Unox 201); limonene dioxide, 3,4-epoxy cyclohexyl -2'4'-dioxy-6',7'-epoxy-spiroindane; butadiene diepoxide, Bisphenol A-epichlorhydrin. The ratio of polyepoxide to copolymer in the mixture can vary over a wide range. The ethylenically unsaturated acid when employed can be used in an amount of 0.01 to 10% of the total copolymer. When hydrophobic monomers are included in making the copolymer, they can be used in an amount as little as 0.1% or as much as 90%. Preferably, the hydrophilic monomer, e. g., hydroxyalky acrylate or methacrylate or lower alkoxy, lower alkyl acrylate or methacrylate is present in an amount of at least 50% of the total monomers.

The floor tile or sheeting can be made from either pure vinyl chloride resin (polymer) or vinyl chloride resin (polymer), containing asbestos as is well known in the art. Usually, the vinyl chloride resin is made from monomers consisting of vinyl chloride alone or a mixture of monomers comprising at least 70% vinyl chloride by weight. The comonomer can be as little as 1% of the monomers. As copolymerizable materials with the vinyl chloride, there can be used 1 to 30%, of a copolymerizable ethylenically unsaturated material such as vinyl acetate, vinyl butyrate, vinyl benzoate, vinylidene chloride, diethyl fumarate, diethyl maleate, other alkyl fumarates and maleates, vinyl propionate, methyl acrylate, 2-ethylhexyl acrylate, butyl acrylate and other alkyl acrylates, methyl methacrylate, ethyl methacrylate, butyl methacrylate and other alkyl methacrylates, methyl alpha chloroacrylate, styrene, trichloroethylene, vinyl ethers such as vinyl ethyl ether, vinyl chloroethyl ether and vinyl phenyl ether, vinyl ketones such as vinyl methyl ketone and vinyl phenyl ketone, 1-fluoro-1-chloroethylene, acrylonitrile, chloroacrylonitrile, allylidene diacetate and chloroallylidene diacetate. Typical copolymers include vinyl chloride-vinyl acetate (96:4 sold commercially as VYNW), vinyl chloride-vinylacetate (87.13), vinyl chloride-vinyl acetate-maleic anhydride (86:13:1), vinyl chloride-vinylidene chloride (95:5), vinyl chloridediethyl fumarate (95:5), vinyl chloride-trichloroethylene (95:5), vinyl chloride-2-ethylhexyl acrylate (80–20).

The vinyl resin can be stabilized as is conventional art. Thus, there can be used organotin stabilizers such as dibutyltin dilaurate or dibutyltin oxide, bariumcadmium laurate, calcium stearate, barium 2-ethyl hexoate, zinc stearate, organic phosphites, e.g., triphenyl phosphite, phenyl didecyl phosphite, diphenyl decyl phosphite, tris decyl phosphite, dibasic lead phosphite, etc.

The invention will be understood best in connection with the drawings, wherein:

FIG. 1 is a plan view of a vinyl chloride resin floor tile having a coating according to the invention, and FIG. 2 is a sectional view along the line 2—2 of FIG. 1.

Referring more specifically to the drawings, there is provided a vinyl chloride polymer tile 2, and there is applied to the upper surface a thin coating 4 of a 2-hydroxyethyl methacrylate polymer to impart improved soil and stain resistance and cleanability.

The vinyl chloride resin floor tile or floor sheeting, e.g., calendered sheeting or pressed sheeting, generally has a thickness of 10 mils to 500 mils usually 1/16 to 1/8 inch.

Typical formulations for making vinyl chloride floor tile (including vinyl chloride-asbestos flooring) are set forth in formulae A to C.

Unless otherwise indicated all parts and percentages are by weight.

FORMULA A

| | |
|---|---|
| Polyvinyl chloride, Number average molecular weight 50,000 specific viscosity 0.40 (0.4 g. in 100 ml. of cyclohexanone at 75°C. | 27.50% |
| barium - cadmium laurate | 0.95 |
| triphenyl phosphite | 0.35 |
| dipropylene glycol dibenzoate | 11.00 |
| epoxidized soybean oil | 1.10 |
| clay | 32.80 |
| −325 mesh calcium carbonate | 25.30 |
| stearic acid | 0.19 |
| paraffin wax | 0.81 |
| | 100% |

FORMULA B

| | |
|---|---|
| Polyvinyl chloride specific viscosity 1.80 (1% in cyclohexanone at 30°C.), Number average Molecular weight 73,000 | 25.0% |
| diisodecyl phthalate | 5.0 |
| clay | 35.0 |
| butyl cyclohexyl phthalate | 3.5 |
| epoxidized soybean oil | 1.0 |
| −325 mesh calcium carbonate | 25.0 |
| polymerized rosin | 1.0 |
| paraffin wax | 0.5 |
| stearic acid | 0.25 |
| rosin - modified glycol ester alkyd resin | 21.0 |
| barium - cadmium laurate | 1.25 |
| phenyl didecyl phosphite | 0.5 |

FORMULA C

| | |
|---|---|
| vinyl chloride — vinyl acetate copolymer (87:13) number average molecular weight 25,000 | 15% |
| alpha methyl sytrene polymer | 2 |
| dioctyl phthalate | 5 |
| hydrocarbon oil (extender plasticizer) | 1 |
| epoxidized soybean oil | 1 |
| barium - cadmium laurate | 1 |
| asbestos (short 7R fibers) | 28 |
| limestone filler | 43 |
| pigment, e. g. titanium dioxide | 4 |

The protective coatings of the present invention can also be used with vinyl chloride floorings of special types such as the tessellated surface products of Almy U.S. Pat. No. 3,170,808, the terrazo effect products of Slosberg U.S. Pat. No. 3,017,714, the light transmitting reflecting floor covering of Smith U.S. Pat. No. 3,049,459. The entire disclosures of Almy, Slosberg and smith are hereby incorporated by references.

Examples of hydrophilic protective coatings according to the invention are given below:

EXAMPLE 1

Hydroxyethyl methacrylate (12 parts), methyl methacrylate (8 parts) and 2-methoxy ethanol (80 parts) are heated in an inert atmosphere to 50°C. Di-isopropyl peroxydicarbonate (0.08 parts) is then added and the temperature brought to 61°C. where it is held until the percent solids reaches 18. After cooling, denatured alcohol (10.8 parts), 2-methoxy ethanol (8 parts), Raybo anti-silking compound No. 3 (a dilute solution in xylene of polymethyl siloxane grease) (0.27 part) and a 20% aqueous solution of ammonium dichromate (0.8 part) are added. This solution is applied to clean flooring material, e.g., tile of Formulation A, B or C using a knife applicator or a curtain-coating machine. The coating is dried, and cured by exposure to ultraviolet light or by heating at 150°C. for 15 minutes. It forms a hard clear film which resists soiling and staining and maintains a gloss under abrasion conditions.

EXAMPLE 2

Hydroxypropyl acrylate (9 parts) methyl methacrylate (10 parts), methacrylic acid (1 part) and 2-methoxy ethanol (80 parts) are heated in an inert atmosphere to 70°C. Azo-bis-(isobutyronitrile) (0.08 part) is added and the temperature brought to 82°C. When the percent solids reaches 18, the solution is diluted to 15% solids with additional ethanol (solvent).

It is applied to a flooring product, e.g., 2-methoxy tile of Formulation A, and allowed to dry. It forms a tough, flexible, waterproof film which is removable with aqueous ammonia.

EXAMPLE 3

The same procedure as in Example No. 1 is followed except that 2-ethoxyethyl acrylate is substituted for methyl methacrylate. The result is a flexible coating material which is applied to rolled sheet polyvinyl chloride flooring.

EXAMPLE 4

Hydroxyethyl methacrylate (16 parts), methyl methacrylate (4 parts) and ethyl alcohol (80 parts) are heated in an inert atmosphere to 70°C. t-Butyl peroxyoctoate (0.06 part) is added and the reaction heated at reflux until a conversion of at least 90% is reached. After cooling, Raybo compound No. 3 (0.54 part) and a 10% aqueous chromic acetate solution (1.6 parts) are added. The solution is applied to clean flooring material of Formulation C, dried, and heated at 135°C. for 30 minutes. The result is a permanent, hard, glossy surface.

EXAMPLE 5

Hydroxyethyl methacrylate (2.5 parts), methyl methacrylate (2.5 parts), methyl acrylate (2.5 parts), 2-methoxy ethanol (76.5 parts), denatured ethyl alcohol (8.5 parts) and azo-bis-isobutyronitrile (0.03 part) are heated in an inert atmosphere to 80°C. After 30 minutes, an additional 2.5 parts of each of the three monomers and an additional 0.03 part of the initiator are added. The reaction is continued until the conversion to polymer reaches 90%. Triethylene diamine (0.08 part), maleic anhydride (0.25 part) and diepoxide ERL 4221 (3, 4-epoxycyclohexylmethyl 3, 4-epoxycyclohexane carboxylate) (0.95 part) are dissolved in xylene (3 parts) and added to the above reaction mixture. After coating on floor tiles of Formulation A, the solvent is air-dried and the coating is baked with infrared lamps to a tough, flexible finish.

EXAMPLE 6

The same procedure is followed as in Example No. 5, except that the ratio of monomers is 60 hydroxyethyl methacrylate: 20 methyl methacrylate: 20 methyl acrylate. The resulting coating is harder and less flexible than in the preceding example.

EXAMPLE 7

Hydroxyethyl methacrylate (7.5 parts), 2-ethoxyethyl acrylate (7.5 parts), 2-methoxyethanol (76.5 parts), ethyl alcohol (8.5 parts) and t-butyl peroxyoctoate (0.06 part) are heated to 80°C. under an inert atmosphere. After the reaction is completed, (Cymel 301) trimethylol melamine (0.375 part) and zinc chloride (0.0075 part) are dissolved into the solution. After application to a flooring material, e.g., Formulation C, the coating is baked at 150°C. for 30 minutes to form a hard, abrasion-resistant surface.

EXAMPLE 8

Hydroxyethyl methacrylate (10 parts) ethoxyethyl methacrylate (8 parts), hydroxypropyl acrylate (2 parts) and 2-methoxyethanol (80 parts) are heated in an inert atmosphere to 70°C. Azo-bis-isobutyronitrile (0.06 part) is added and the reaction mixture heated at 80°C. until no more conversion to polymer occurs. Denatured ethyl alcohol (6 parts), 2-methoxyethanol (4.5 parts), Raybo compound No. 3 (0.15 part), xylene (2.6 parts), maleic anhydride (0.24 part), diepoxide ERL-4221 (0.9 part) and stannous octoate (0.08 part) are added. The hydrophilic polymer is applied to polyvinyl chloride tile of Formulation A and the coated product is air-dried and baked at 150°C. to give a permanent, flexible, protective coating.

EXAMPLE 9

Sodium lauryl sulfate (0.75 part) and potassium persulfate (0.05 part) are added to deionized water (100 parts), and purged with carbon dioxide. 2-Ethoxyethyl methacrylate (35 parts) and 2-methoxyethyl methacrylate (15 parts) are added while stirring well. The mixture is heated to 65°C. with constant stirring and the reaction continued until conversion to polymer ceases. The resulting water-based latex can be applied to flooring materials such as Formulation A, B and C to form a stain-resistant protective finish.

EXAMPLE 10

The same procedure as in Example No. 9 is followed, except that the monomers used are 2-ethoxyethyl acrylate (25 parts), 2-ethoxyethyl methacrylate (20 parts) and 2-hydroxyethyl acrylate (5 parts). A similar latex, useful for a protective floor coating is formed.

Application of the coating to the vinyl tile or sheeting can also be accomplished by spraying. The hydrophilic coating of the present invention can be quite thin. Thus, it normally has a thickness of 0.05 to 1 mil. In the examples, the thickness was about 0.3 mil.

As used in the present claims, the term "homopolymer" does not exclude the presence of the trace amounts of ethylene glycol dimethacrylate units normally present in hydroxyethyl methacrylate "homopolymers" or similar trace amounts of the glycol diacrylates and methacrylate units present in polymers from the other hydroxyalkyl hydrophilic monomers mentioned.

I claim:

1. A vinyl chloride polymer flooring material, in the form of tile or sheeting, having a thickness of 10 to 500 mils and having a protective outer coating consisting essentially of a hydrophilic acrylic polymer selected from the group consisting of homo polymers of hydroxyethyl acrylate, hydroxypropyl acrylate, hydroxyethyl methacrylate, hydroxypropyl methacrylate, methoxyethyl acrylate, ethoxyethyl acrylate, methoxyethyl methacrylate and ethoxyethyl methacrylate.

2. Flooring material according to claim 1, wherein the hydrophilic acrylic polymer is polymerized hydroxyethyl methacrylate.

* * * * *